US005549480A

United States Patent [19]

Cheng

[11] Patent Number: 5,549,480

[45] Date of Patent: Aug. 27, 1996

[54] UNITARY CONNECTOR ALLOWING LATERALLY VARIANT POSITIONS OF MATING CONTACTS OF COMPLEMENTARY CONNECTOR

[75] Inventor: Lee M. Cheng, Cupertino, Calif.

[73] Assignee: Tongrand Limited, Hong Kong, Hong Kong

[21] Appl. No.: 243,146

[22] Filed: May 17, 1994

[51] Int. Cl.[6] ..... H01R 23/70

[52] U.S. Cl. ..... 439/79; 439/682; 439/733.1

[58] Field of Search ..... 439/79, 80, 101, 439/108

[56] References Cited

U.S. PATENT DOCUMENTS

| | | | |
|---|---|---|---|
| 3,538,489 | 11/1970 | Bennett et al. | 439/701 |
| 4,582,386 | 4/1986 | Martens | 439/101 |
| 4,607,907 | 8/1986 | Bogursky | 439/682 |
| 4,871,321 | 10/1989 | Johnson | 439/79 |
| 5,067,915 | 11/1991 | Kienast | 439/620 |
| 5,186,639 | 2/1993 | Comerci et al. | 439/512 |
| 5,238,413 | 8/1993 | McCaffrey et al. | 439/79 |

FOREIGN PATENT DOCUMENTS 1073506 6/1967 United Kingdom .

*Primary Examiner*—Neil Abrams

[57] ABSTRACT

A female connector (30) comprises an elongated housing (32) and two separate blades (34, 36). The housing (32) includes one power region (40) and one signal region (50) spaced from each other by a space (90) therebetween. The power region (40) includes a plurality of first passageways (42) for receiving a corresponding number of first contact (60) therein. The signal region (50) includes a plurality of second passageways (52) for receiving a corresponding number of second contacts (70) therein. The opening (41) of the passageway (42) has an expanded curved contour (48) on two sides for allowance of lateral deviation of an inserted male contact, and the first contacts (60) includes a pair of arms (66) arranged to face each other in a vertical direction for being adapted to receive the deviated inserted male contact of a complementary connector (14).

1 Claim, 6 Drawing Sheets

UNITARY CONNECTOR ALLOWING LATERALLY VARIANT POSITIONS OF MATING CONTACTS OF COMPLEMENTARY CONNECTOR

BACKGROUND OF THE INVENTION

1. Field of the Invention

The invention relates to connectors adapted to accommodate different positioned contacts of the complementary connectors wherein the mating contacts of different complementary connectors may deviate in a range from the centerline of the mating contacts of the subject connector.

2. The Prior Art

As generally used in computer industry and shown in FIG. 1, at least two sets of the circuits and their corresponding male connectors are dispensed on the PC board which is generally horizontally positioned in the interior of the computer. Among these two sets, one set is of signal issue and the other is of power issue wherein the contacts of the power connector are of a larger dimension and a small number, and arranged in a larger pitch form. In contrast, the contacts of the signal connector are of smaller dimension and a large number, thus being of a small pitch arrangement. In the conventional arrangement, the power connector 10 and the signal connector 12 are of the Header type, and respectively solderably mounted on the PC board and respectively mating with two separate complementary connectors, i.e. other Header connectors, which are respectively connected, through IDC (Insulative Displacement Contact) means, to flat cables. Such flat cables are, directly or indirectly, respectively connected to the power circuit of the main board if such cable is related to the power connector 10, and to the signal circuit on the main board if such cable is related to the signal connector 12.

The aforementioned power connector 10 and the signal connector 12 may be mounted on the board of any functional unit, e.g. the harddisk, in the computer. In the recent trend, some manufacturers intend to arrange the these two Header connectors 10, 12, i.e., the power one and the signal one, as a unitary piece for the consideration of saving cost, as shown in FIG. 2. In other words, this unitary connector has the power section 11 and the signal section 13 thereof. Then, the complementary power and signal connectors respectively associated with their own IDCs and flat cables are respectively mated with the power section 11 and the signal section 13 of this unitary Header connector 14. U.S. Pat. Nos. 5,024,609 and 5,145,411 may be deemed related to the similar concept.

In the present invention, an attempt is taken that the complementary separate power and signal connectors which are connected to the flat cables via the IDCs, may be integrated to be of a one piece to properly mate with the aforementioned corresponding unitary Header connector 14 on the PC board for lowering the cost. U.S. Pat. No. 5,184,961 discloses a matter related to the similar concept.

Certainly, if the unitary connector 14 on the PC board and the unitary complementary connector are made by a same manufacturer and have been configured to compactly mate with each other, this coupling will be appreciably good and operative. Unfortunately, most computer manufacturers who buy the different components including various connectors from outside different vendors to assemble the whole computer system, may get these two complementary connectors from two different parties. Then, the problem may occur. The reason is that the standard specification to meet is only referred to the dimensions of the respective power connector 10 and the respective signal connector 12 such as the matter regarding the dimension of the outer configuration or inner space of the standard connector where will accommodate the corresponding portion of the complementary connector associated with the flat cable. As specified, the pitch between two adjacent contacts of the power connector 10 is 5.08 mm and that between two adjacent contacts of the signal connector 12 is 2.54 mm. When the power connector 10 and the signal connector 12 are lengthwise juxtaposed together in form of one integral unit, there is no standard regulation, till now, regarding the distance between the innermost contact 16 of the power connector 10 and the innermost contact 18 of the signal connector 12 wherein these two innermost contacts 16 and 18 oppositely face to each other with a partition 20 intermediating therebetween. In other words, the variation of thicknesses of the partition 20 in the lengthwise direction of this unitary connector will vary the dimension of the whole connector in the lengthwise direction even though the power contacts section 11 and the signal contacts section 13 still meet the standard requirement, respectively.

If the complementary component to this unitary connector 14 positioned on the PC board is composed of two connectors such as the conventional type, there may be no problem for mating because the individual complementary power connector and the individual complementary signal connector can respectively and adequately mate the corresponding power section 11 or the corresponding signal section 13 of such unitary connector 14 without interference with each other due to the power section 11 and the signal section 13 of the unitary connector 14 being in compliance to the standard specification, respectively.

However, as mentioned before, some computer manufacturers also tend to use a unitary complementary connector, which comprises the power region and the signal region connectedly associated with the respective flat cables, corresponding to such unitary connector 14 mounted on the board for saving cost. Then, some unexpected matters will happen to the mating of these two unitary connectors. Understandably, the relative positions of the power section and of the signal section in the unitary connector 14 on the PC board do not precisely comply with those of the power region and of the signal region in the unitary complementary connector which is connected to flat cables if these two mutually complementary unitary connectors are made by two different connector manufacturer and have different distances between the power section/region and the signal section/region. In other words, if the signal section 13 of the connector 14 on the PC board can mate the signal region of the complementary connector associated with the flat cables, then, the power section 11 of the connector 14 on the PC board cannot be adequately coupled to the power region of the complementary connector associate with flat cables. From a viewpoint of engineering, that is, the centerline of each contact in power region of the complementary connector deviates from the centerline of the corresponding power contact in the power section 11 of the connector 14 out of an acceptable range. Accordingly, under the situation that the signal contact section 13 of the connector 14 in position can be adapted to be aligned with and mated with the signal region of the complementary connector, the male pin of the power section 11 of the connector 14 on the PC board can not be in alignment with the female receptacle of the power region of the complementary connector having associated flat cables, and even can not be inserted into the opening of the corresponding passageway of the complementary connector in which the female receptacle is received. As a result, the unitary connector 14 and its complementary connector still can not be completely and correctly coupled to each other and fail to work with each other.

Accordingly, an object of the present invention is to provide a complementary female connector having a unitary housing enclosing a power region and a signal region and being adapted to couple to a male connector 14 which is positioned on the PC board and also has a unitary housing enclosing a power section and a signal section regardless of insignificant difference of the distances between the power region and the signal region in the subject female connector and between the power section and the signal section in the male connector 14 mounted on the PC board.

Additionally, another important trend of the recent industry is component modulization. As shown in U.S. Pat. Nos. 4,941,841, 5,139,439 and 5,277,615, the harddisk or the like is designedly modulized to be a detachable slide-in device from the computer set so that the whole system can be optionally upgraded by adding such harddisk thereto. For consideration of low insertion force, the scientific way to couple the slide-in harddisk to the computer set is to use a card edge connector disposed in the computer set for receiving a card-like portion of such slide-in harddisk, as shown in U.S. Pat. No. 5,277,615. Unfortunately, the most harddisks commonly use the pin type male connectors to mate the corresponding socket type female connectors disposed in the computer set, as shown in FIG. 1 and described in the previous paragraphs. Therefore, another object of the present invention is to provide an adaptor which not only has a unitary housing comprising the power region and the signal region on the front portion to conformably mate the corresponding unitary connector which is mounted on the PC board and is composed of the power section and the signal section thereof in the front portion for mating with the power region and the signal region of the subject connector, but also includes plate-like means on the rear portion for slidable reception within a card edge connector which is connected to plural flat cables through IDCs.

SUMMARY OF THE INVENTION

In accordance with one aspect of the invention, the subject connector has a unitary housing comprising a power region and a signal region, each region having more than one contacts extending therethrough wherein the contact of the power region is relatively larger than that of the signal region. When the contact is received in the corresponding passageway in the connector of the power region, the contact of the power region has a configuration which provides thereof a through-opening, proximate the front portion of the passageway, in a direction lateral to the lengthwise direction of the contact. The passageway of the contact of the power region includes an opening which has a reduced dimension with respect to the cross-section of the passageway but has an expanded contour in a lengthwise direction in respect to the housing of the connector. Therefore, in a condition that another complementary connected which may be mounted on the PC board has a power section and a signal section wherein the power section of the complementary connector can not be appropriately aligned with the power region of the connector when the signal section of the complementary connector is in positionable alignment with the signal region of the connector, the lateral through-opening of the contact of the power region and the lateral expansion of the opening of the passageway in the power region of the connector may be forgiving to a larger acceptable deviation of a centerline of the contact of the power section of the complementary connector with regard to its corresponding contact of the power region of the connector.

The connector may further comprises in the rear at least a blade on which the tails of the contacts, regardless of the power region or the signal region, are attached as fingers such that when the blade is slidably and matably inserted into a card edge connector which is connected to power and signal flat cables, such fingers can be electrically engaged to the corresponding contacts within the card edge connector. Accordingly, the conductive transmission is completed from the PC board on which the complementary connector 14 is seated, through the complementary male connector 14 which is mating with the subject female connector in the front, the subject connector, the card edge connector which is mating with the subject connector in the rear, and the flat cables connected to the rear portion of the card edge connector, to the main board for operation. de

DETAILED DESCRIPTION OF THE PREFERRED EMBODIMENT

Reference will now be made in detail to the preferred embodiment of the invention. While the present invention has been described with reference to a specific embodiment, the description is illustrative of the invention and is not to be construed as limiting the invention. Various modifications to the present invention can be made to the preferred embodiment by the those skilled in the art without departing from the true spirit and scope of the invention as defined by the appended claims.

Figure 1:
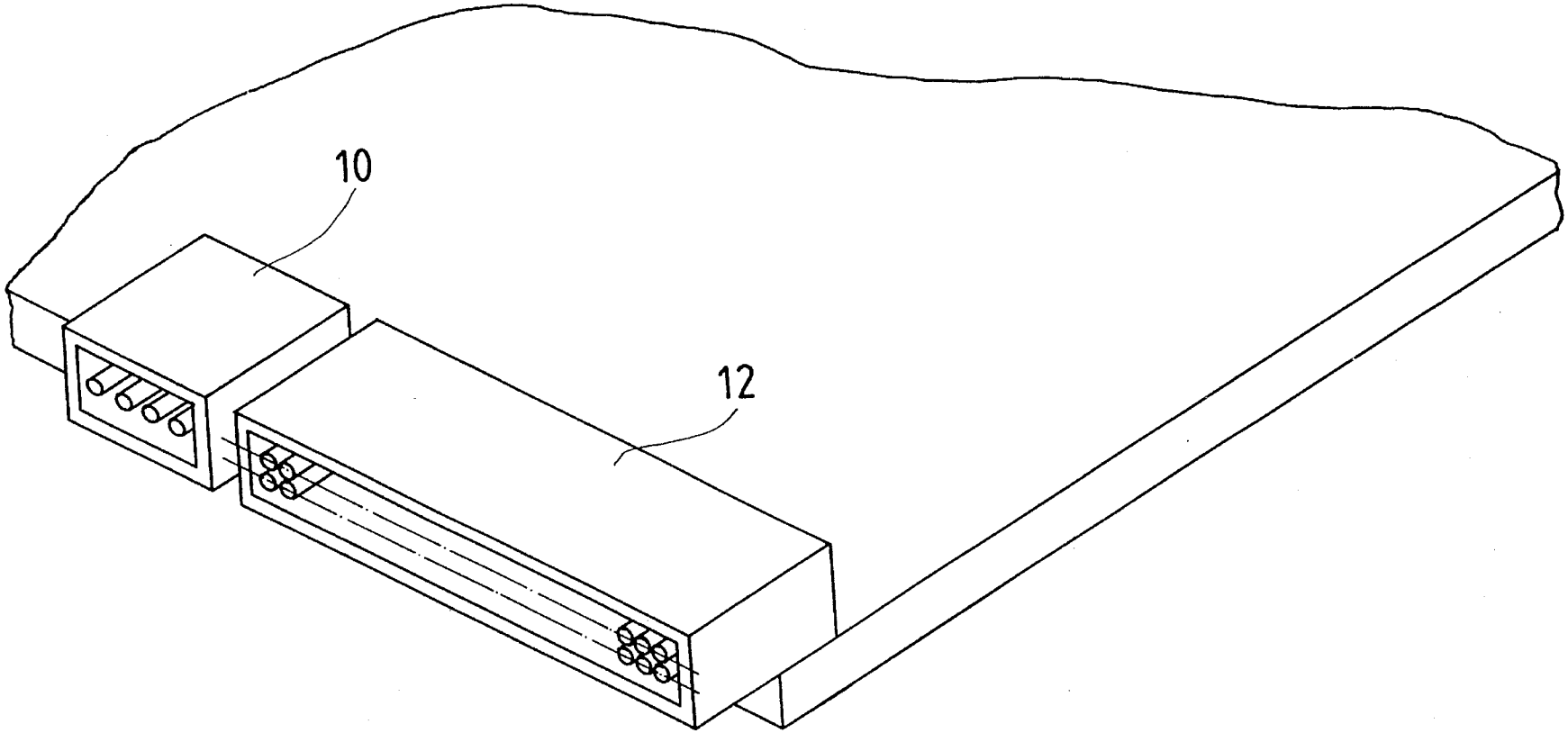
FIG.1 (PRIOR ART)
FIG. 1 is a perspective view of the prior art connector assembly, on the PC board, having the separate power connector and signal connector.
Figure 2:
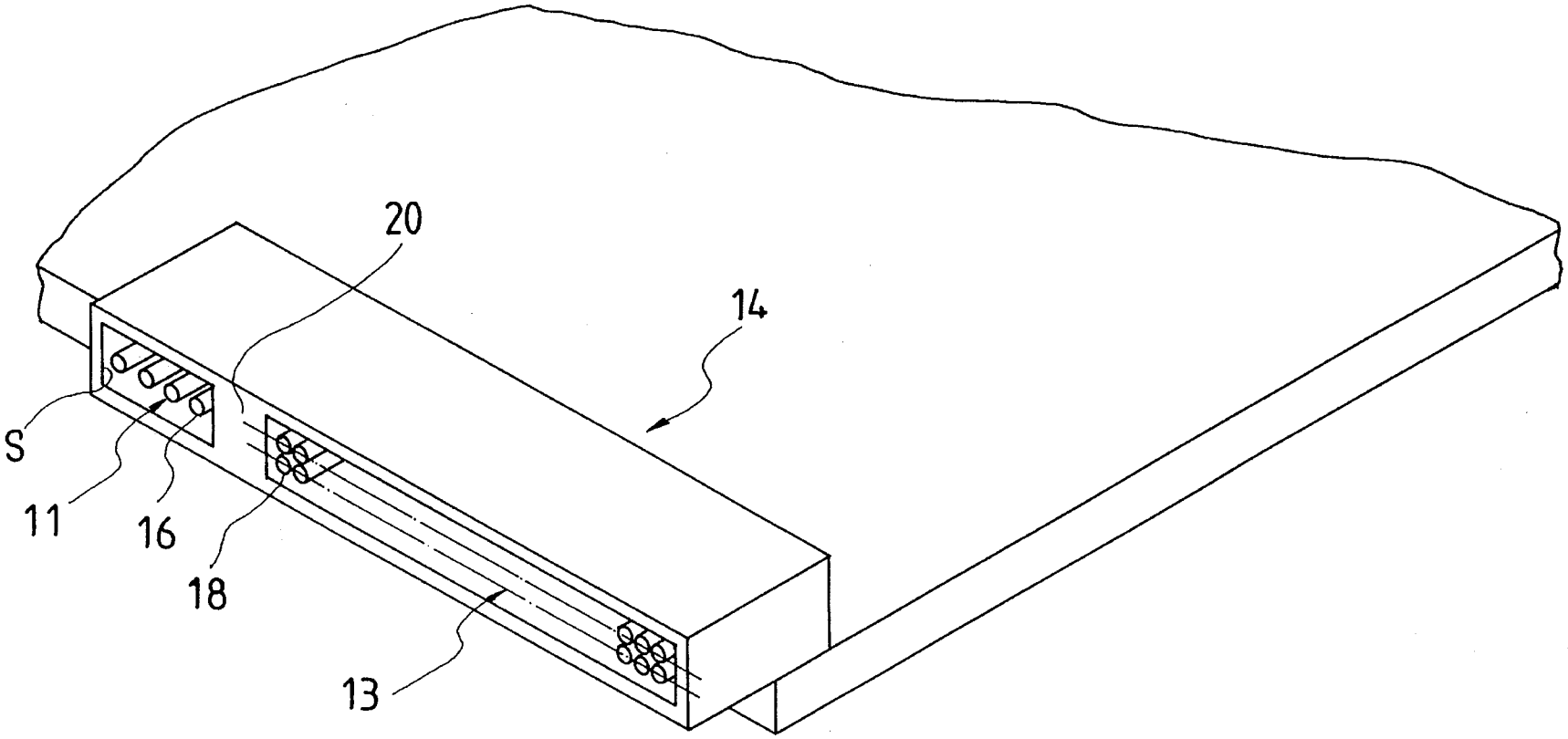
FIG.2 (PRIOR ART)
FIG. 2 is a perspective view of the conventional connector on the PC board used in the hard disk drive, having a unitary housing enclosing a power section and a signal section.
Figure 3:
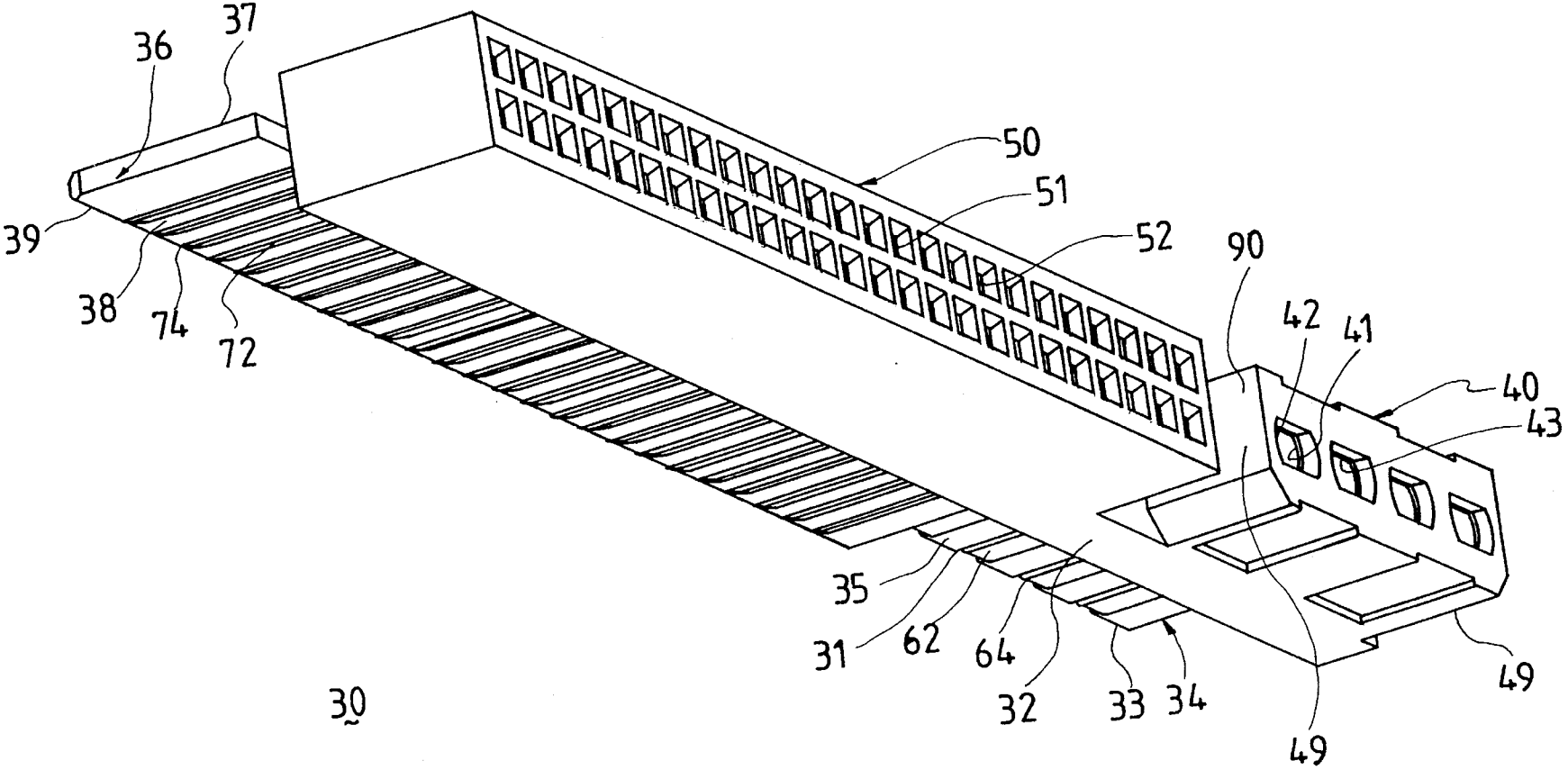
FIG. 3 is a bottom perspective view of a presently preferred embodiment of a unitary connector which is complementary to the connector 14 on the PC board disclosed in FIG. 2, in accordance with the present invention.

It will be noted here that for a better understanding, like components are designated by like reference numerals throughout the various figures. Attention is now directed to FIG. 3 where the subject electrical connector, designated 30 is illustrated. In the preferred embodiment, the female connector 30 comprises an elongated housing 32 and two separate blades 34, 36 in the rear for mating with a male connector such as 14 shown in FIG. 2. The housing 32 includes one first or power region 40 and one second or signal region 50 spaced from each other by a space 90 therebetween.

The power region 40 includes one row of large first passageways 42 arranged along the power region 40 in a lengthwise direction of the housing 32, and each passageway 42 extends therethrough in a front-to-back direction of the connector 30. In the present embodiment, the passageway 42 has a generally square cross-section in compliance to the inserted square type power contact 60 which will be illustrated in detail later. The blade 34 integrally and connectedly extend rearward from the upper portion of the power region 40 wherein the bottom surface 35 of the blade 34 is coplanar with the top inner surfaces 43 of the housing 32 around the passageways 42. This coplanarity of the inner surface 43 with the bottom surface 35 allows the rearward extending tail 62 of the power contact 60 of FIG. 4(A) compactly abuts against the bottom surface 35 of the blade 34.

Two rows of small second passageways 52 are disposed along the signal region 52 wherein each passageway 52 extends therethrough in the front-to-back direction which is same as that of the passageway 42. The blade 36 extends rearward from a middle portion of the back surface of the signal region 50 whereby the top surface 37 of the blade 36 is coplanar with the inner bottom surfaces (not shown) of the housing 32 around the upper row passageways 52, and the bottom surface 38 of the blade 36 is coplanar with the inner surfaces (not shown) of the housing 32 around the lower row passageway 52. Similar, the coplanarity of the blade surfaces 37, 38 with the inner surfaces of the upper and lower row passageways 52 facilitates the tails 72 of the signal contact 70 of FIG. 4(B), which will be illustrated in detail later, compactly abutting against two sides of the blade 36, respectively.

It can be understood that the front edge 39 of the blade 36 is tapered and dimension-reduced so that the tips 74 of the tails 72 of the signal contacts 70 can be sightly bowed or converged toward the blade 36 in order to be efficiently attached thereto. To achieve the same function, the front edge 33 of the blade 34 has a plurality of indents 31 thereof in alignment with the tails 62 of the power contacts 60 so that the tips 64 of the tails 62 of the power contact 60 can be snugly securely embedded within the indents 31, respectively, without the possibility of any lateral movement or detachment thereof.

Figure 4A:
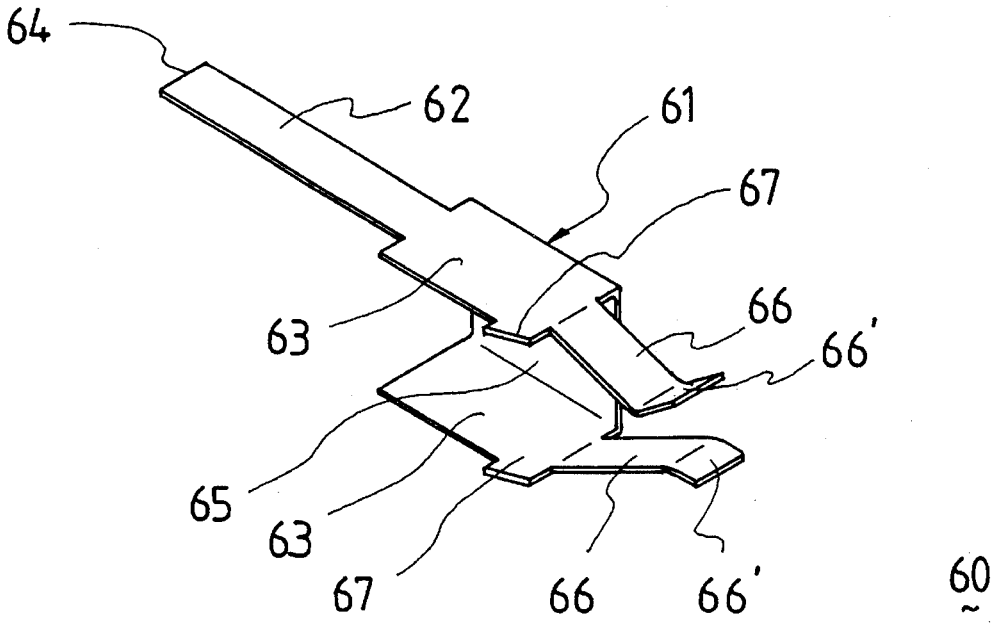
FIG. 4(A) is a perspective view of the contact of the power region in the connector of FIG. 3.
Figure 4B:
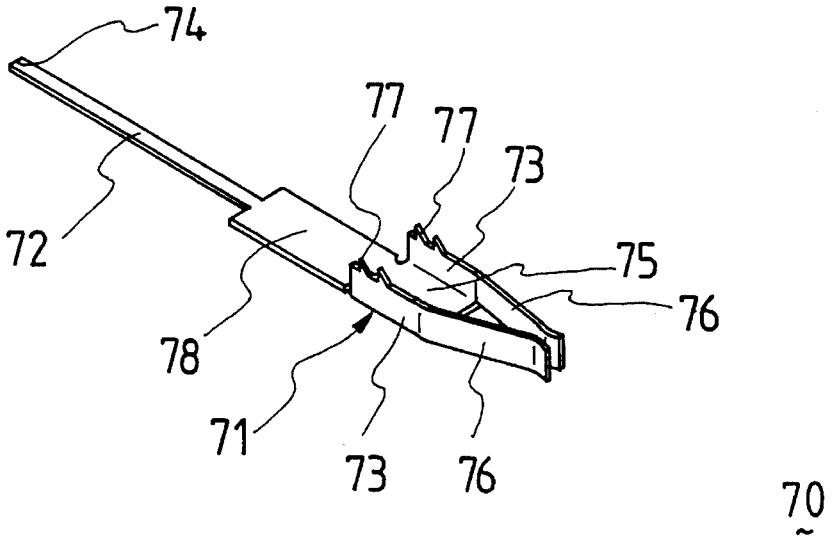
FIG. 4(B) is a perspective view of the contact of the signal region in the connector of FIG. 3.

Referring to FIG. 4(B), the female second contact 70 of the signal region 50 formed by stamping and bending a strip of metal blank and received within the corresponding passageway 52 of the signal region 50, includes a generally U-shaped body 71 including a pair of retention walls 73 extending vertically from two sides of a base 75. At least a pair of barbs 77 are integrally positioned on the top of the retention walls 73, respectively. A pair of spring arms 76 integrally and respectively extend from the retention walls 73 forwardly and converge to each other approximate the their front ends for appropriately exerting a retention force to an inserted pin type male contact of the complementary connector (not shown). An elongated plate 78 integrally extends rearward from the base 75. An elongated tail 72 integrally extends rearward from the rear portion of the plate 78.

Figure 5:
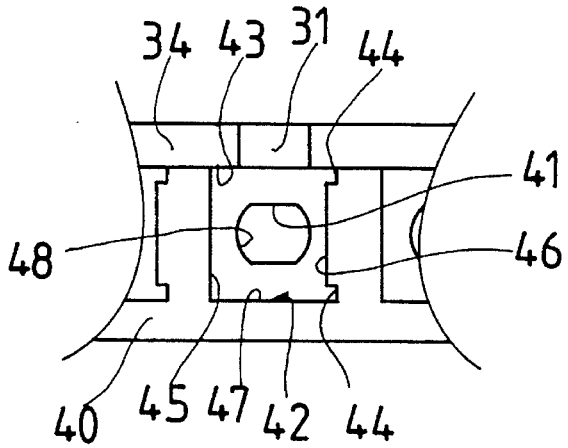
FIG. 5(A) is a back plane view of a portion of the power region of the connector of FIG. 3 to show the elevation view of the passageway therein.
FIG. 5(B) is a back plane view of a portion of the signal region of the connector of FIG. 3 to show the elevation view of the passageway therein.
Figure 5:
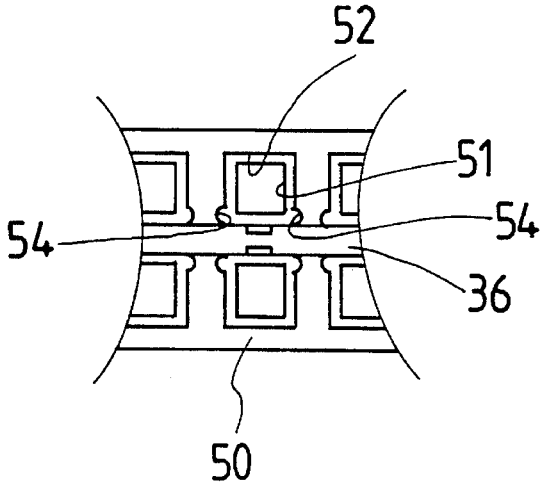

Also referring to FIG. 5(B), each passageway 52 of the signal region 50 has a generally square cross-section to correspond to the cross-section of the contact 70. It can be noted that the vertical height of the cross-section of the passageway 52 is almost identical to the height of the retention walls 73 of the U-shaped body 71 so that the contact 70 can be retainably received within the corresponding passageway 52 by means of the interference occurring between the barbs 77 and the inner surface of the housing 32 around the passageway 52. It is also seen that the width of the plate 78 is sightly larger than the average width of the cross-section of the passageway 52 such that a pair of opposite grooves 54 are communicatively positioned beside the passageway 52 and proximate the inner surface of the housing which is coplanar with the blade 36. Accordingly, two side edges of the plate 78 can be snugly received within the grooves 54, respectively, for restraint of vertical movement of the contact 70 when the contact 70 is inserted into the passageway 52. It can be seen that when assembled, the opening of such U-shaped body 71 is facing to a direction away from the blade 36, and the base 75 and the plate 78 of the contact 70 are tightly seated on the inner surface of the housing 32 which is coplanar with the surface of the blade 36. Naturally, the tail 74 of the contact 70 is also tightly mounted on the corresponding surface of the blade 36. It is also appreciated that the passageways 52 of the upper row and those of the lower row in the signal region 50 are symmetrical with regard to the blade 36 because the blade 36 extends from the middle portion thereof, and thus, the installation of the upper row contact 70 thereof is opposite to that of the lower row contact 70. As a result, the tails 72 of the upper row contact 70 cooperating with the tails 72 of the lower row contact 70, can sandwich the blade 36 therebetween to form an edge device having fingers thereon for electrical reception within a corresponding card edge connector.

It can be seen that each passageway 52 has a dimension-reduced opening 51 at its front end with circumferential chamfers for aligning the inserted pin type male contact (not shown). The reduced opening also prevents any misaligned pin type male contact from insertion into the spaces between the arms 76 of the contact 70 and the adjacent inner surfaces of the housing 32 around the passageway 52 under the condition that such space is provided for allowance of the deflection of the arms 76 when the pin type male contact is inserted into the passageway 52. In other words, the front tips of spring arms 76 of the contact 70 within the passageway 52 are positioned outside the dimension defined by the opening 51 of the passageway 52, and it assures the inserted pin type male contact will be inserted into the inner space surrounded by the corresponding arms 76. Moreover, the dimension-reduced opening 51 centers the inserted pin type male contact for properly reception of the male contact within the corresponding socket type female contact. This is a well-known common way in the connector field and can be referred to aforementioned U.S. Pat. No. 5,145,411.

The main feature of the present invention is related to the structure of the passageway 42 in the power region 40 and its corresponding contact 60 received therein. Referring to FIG. 4(A), similar to the contact 70 of the signal region 50, the female contact 60 of the power region 40 includes a generally U-shaped body 61 extending in the front-to-back direction and having a pair of retention walls 63 extending from two, i.e. upper and lower sides of a base 65 and perpendicular to the base 65. A pair of barbs 67 are respectively positioned on the top of the retention walls 63. A pair of spring arms 66 integrally extend forwardly from the retention walls 63, respectively. Different from the tail 72 of the contact 70 of the signal region 50 which extends from the plate 78 extending from the base 75 of the U-shaped body 71, the tail 62 of the contact 60 directly integrally extends from one retention wall 63 of the U-shaped body 61 of the contact 60. This configuration results in a different form of installation of the power contact 60 within the passageway 42 of the power region 40 in comparison with the signal contact 70 within the passageway 52 of the signal region 50.

The first contact 60 of the power region is received within the corresponding passageway 40 wherein such U-shaped body 61 is facing a lateral direction which is directing in a lengthwise direction of the connector housing 32. It can be understood that from a viewpoint of the whole connector including the power region 40 and the signal region 50, there is a 90 degrees rotation difference between the U-shaped body 61 and the U-shaped body 71 when the U-shaped body 61 of the contact 60 received within the corresponding passageway 42 of the power region 40 is compared with the U-shaped body 71 of the contact 70 received within the corresponding passageway 52 of the signal region 50.

Referring to FIG. 5(A), the height of the cross-section of the passageway 42 is generally identical to the width of the base 65 of the contact 60 so that the base 65 can be against one side inner surface 45 of the housing 32 around the passageway 42. While, the width of the square cross-section of the passageway 42 is somewhat smaller than the height of the retention wall 63. Accordingly, a pair of opposite groove 44 and 44' are positioned proximate the another side inner surface 46 of the housing 32 around the passageway 42, which is opposite to the inner surface 45 wherein the upper groove 44 is generally aligned with the top surface 43 around the passageway 42 and the lower groove 44' is generally aligned with the bottom surface 47 around the passageway 42.

Figure 7:
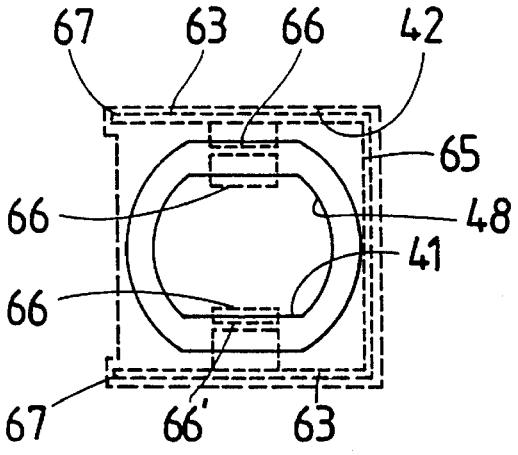
FIG. 7 is an enlarged plane view to illustrate the relationship among the passageway of the power region, the opening of such passageway and the contact in such passageway.

When assembled, also referring to FIG. 7, the retention walls 63 of the contact 60 abut against the top inner surface 43 and the bottom inner surface 47 of the housing, respectively, and the top portions of the retention walls 63 can be embedded within the groove 44 and 44' with an interference fit by means of the projecting barbs 67 thereof so that the contact 60 is retainably received within the passageway 42 without any vertical or horizontal movements. The tail 62 of the contact 60 which extends from the upper retention walls 63, is naturally seated on the bottom surface 35 of the blade 34 because the bottom surface 35 of the blade 34 is coplanar with the top inner surface 43 around the passageway 42.

Under this situation, it can be noted that different from the signal region 50, the spring arms 66 of the contacts 60 within the passageway 42 are arranged in a vertical direction. This arrangement incorporating the specific shaped opening 41 of the passageway 42, facilitates allowing deviation of centerline of the inserted pin type male contact and that will be illustrate in detail later.

Figure 6:
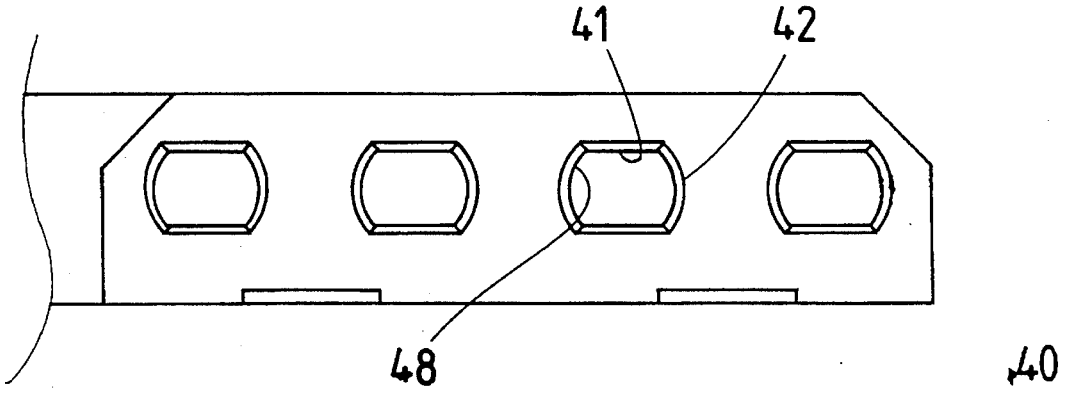
FIG. 6 is a fragmentary front plane view of the connector of FIG. 3 to show the openings of the passageways of the power region.

Similar to the opening 51 of the passageway 52 in the signal region 50, referring to FIG. 6, the opening 41 of each passageway 42 has a reduce dimension relative to the cross-section of the passageway 42 for the same reason aforementioned as the opening 51 of the passageway 52. While, the opening 51 of the passageway 52 are radially shrunk, relative to the passageway 52, in both vertical and horizontal directions. Differently, the opening 41 of the passageway 42 originally has the same configuration as the square opening 51 of the passageway 52, but intentionally further expands in a horizontal direction. In this embodiment, the opening 41 of the passageway 42 has an expanded curved contour 48 on each of its two lateral sides for provision of more space in the lateral or horizontal direction of the opening 41.

The relationship among the passageway 52, its opening 51 and the contact 70 therein of the signal region 50 in the present embodiment, is commonly used in the generally connectors and is not further described in detail hereinafter. While FIG. 7 shows the relationship among the passageway 42, its opening 41 and the contact 60 therein of the power region 40 in the present embodiment, and this arrangement is different from that in the signal region 50.

In the general connector, there is hardly any space in the opening allowing any deviation of the centerline of an inserted pin type male contact because the opening is designedly arranged in an equal distance from the imaginary center point to sides of the peripheral of the opening and kept as small as possible for centering the inserted male contact. Certainly, such conventional arrangement precludes the possibility of mating with a complementary connector which has a row of pin type male contacts under the condition that the centerline of each inserted male contact is deviated from the centerline of the corresponding female contact positioned within the passageway.

Figure 8:
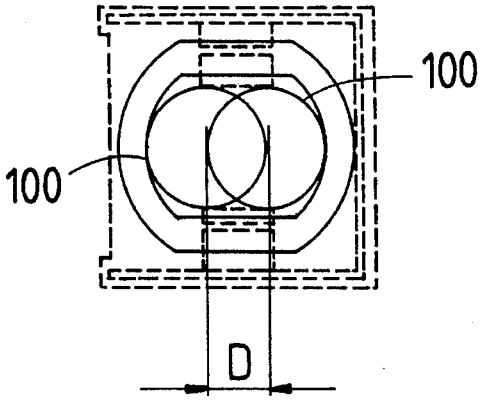
FIG. 8 is a plane view illustrating a deviation allowed for a pin type male contact which is inserted into the passageway from the opening and coupled to the contact of FIG.7.

In contrast, referring to FIG. 8, the opening 41 of the passageway 42 allows a deviation D of the centerline of an inserted male contact 100 in a lateral or horizontal direction by its expanded curved contour 48 on its two sides, while the top edge and the bottom edge of the opening 41 still keep straight and keep original distance to the center point. This arrangement is efficiently forgiving to the deviations of the power sections of the different complementary connectors 14 each of which has the power section 11 and the signal section 13 within a unitary housing wherein the deviations of the power sections of the different complementary connectors 14 result from the different thicknesses of the partition walls 20 of the different connectors 14 as shown in FIG. 2. In other words, the arrangement can solve the aforementioned problem derived from the variant relative lengthwise positions of the power section and the signal section within the unitary housing of the complementary connector 14. It can be noted that in the present invention, the capability of being adapted to accommodate different positioned power sections of the different complementary male connectors not only results from the expanded curved contour 48 on two sides of the opening 41 of the passageway 42, but also from the two parallel spring arms 66 being arranged in a vertical direction and forming a through-opening in a lateral or horizontal direction so that there is no obstacle within the passageway 42 in the lateral or horizontal direction when an male contact is inserted therein which is somewhat laterally deviated from the centerline defined by the spring arms 66 of the contact 60 or the passageway 42.

It can be understood that the retention force exerted by the spring arms 66 of the contact 60 designedly meets the minimum required limitation between the female contact 60 and the inserted corresponding male contact of the complementary connector 14 as shown in FIG. 2, in a vertical direction even though the male contact is somewhat deviated from the centerline of the spring arms 66, e.g. in the outermost right or left position. The laterally enlarged opening 41 in the present invention might be inferior to an originally sized opening used in the general connector in some conditions that the general connector opening might adjust or align some little misaligned inserted male contact, but without doubt the opening 41 incorporating the corresponding contact 60 therein in the present invention can still designedly appropriately work with the inserted male contact of the complementary connector.

It is appreciated that the reason why the expanded curved contour 48 of the opening 41 is positioned on two sides of the opening 41 is to correspond to the horizontal deviation of the corresponding inserted male contact. Because there is hardly any possibility of vertical deviation of the male contact, it is no consideration regarding the expanded curved configuration, similar to that on two sides of the opening 41, being disposed in a vertical direction around the opening 41. In the present embodiment, similar to the contact 70 of the signal region 50 within the passageway 52, the tip 66' of the arm 66 of the contact 60 of the power region 40 is hidden behind and radially away from the opening 41 of the passageway 42 and this assures the inserted male contact will be correctly inserted into the inner space between the two arms 66.

It can be contemplated that the expanded curved contour 48 of the opening 41 on two sides is designed to comply with the shape of the inserted circular type male contact in the present embodiment. In other embodiments, a straight contour on two sides of the opening 41 may replace the curved contour 48 for corresponding to an inserted square type male contact. From another viewpoint, because the width of each spring arm 66 is somewhat smaller than the width of the cross-section of the passageway 42 which the spring arm 66 is received in, the expanded curved contour 48 in the present embodiment is not necessary and not appropriate to expand too far to form a large opening having the similar or even larger dimension of the cross-section of the passageway 42 for accommodation of a broader range deviation of the inserted male contact. Accordingly, the proper size of the opening 41 is to have the inserted male contact be still able to engage sufficient portions of the arms 66 of the contact 60 with a required minimum retentive normal force exerted therebetween. For example, in the present embodiment, for the circular type male contact of the complementary connector, the vertically diametrically opposite top and bottom points which contact the arms 66 of the contact 60, respectively, should be positioned in the range equal to or smaller than the width of each arm 66 of the contact 60. The lateral dimension of the opening 41 of the passageway 42 may be altered according to the diameter of the inserted pin type male contact and the width of the spring arms 66 of the female contact 60. Anyhow, the better arrangement may be referred to the present embodiment where horizontal deviation of the male contact of the complementary connector may be less than one third of the width of the arm 66 of the contact 60. In a true product according to the present invention, a value of 0.4 mm of the horizontal deviation of the male contact of the complementary connector is acceptable.

It can be appreciated that the shape itself of the opening 41 is not the key point in this invention because a square cross-sectional contact generally incorporates a square cross-sectional passageway and its associated square opening, and a circular cross-sectional contact generally incorporates a circular cross-sectional passageway and its associated circular opening. In other words, the opening of the passageway of the power region may be any shape, even a hexagon, to correspond to its accompanying inner contact. The feature of the present invention is to provide an enlarged opening having more space in the lateral direction to accommodate deviation of the centerline of the male contact which is inserted therein from the outside. Accordingly, the opening has a bigger dimension in a lateral direction than in a vertical dimension. This configuration is different from that of the opening in the common connector which generally has a square or a round shape thereof.

It can be noted that the reason why, in the present invention, the reformation is designedly implemented with the opening 41 of the passageway 42 in the power region 40, is that the passageway 42 of the power region 40 is low density arranged and each power contact 60 in the passageway 42 has a larger dimension than the contact 70 in the signal region 50. It is inconvenient and improper to have the opening 51 of the passageway 52 in the signal region 50 use the same structure as the opening 41 of the passageway 42 in the power region 40 to replace the reformation disposed on the opening 41 of the passageway 42 in the power region because the passageway 52 in the signal region 50 is of high density arrangement, and the dimension of the contact 70 in the signal region 50 are far smaller than that of the contact 60 in the power region 40, and thus any deviation imposed on the signal region has a relatively more significant mechanical effect than on the power region. That is, in comparison with the signal region 50, the power region 40 having the bigger sized passageway 42, its associated opening 41 and contact 60 therein, is superior to the signal region 50 when a horizontal deviation is imposed thereon. From another viewpoint, the opening 41 of the passageway 42 in the power region 40 receives a bigger corresponding power male contact of the complementary connector 14 as shown in FIG. 2 which, unlike the tiny signal male contact subject to oblique misalignment, generally has a strong and straight body, so that there is hardly any requirement to adjust or align such male contact by means of a shrunk opening of the passageway 42 of the power region 40. This is the reason why the opening 41 having a lateral expansion in the present invention can still work with the male contact of complementary connector, as illustrated before.

It is also noted that in the present invention, the lengthwise dimension of the power region 40 may be slightly smaller than the lengthwise dimension of the inner space S of the power section of the complementary connector as shown in FIG. 2, and this reduction may be implemented by thinning the side walls 49 of the power region 40 of the housing 32. This reduction of the lengthwise dimension of the power region 40 allows mechanically and electrically mating between the power region 40 of the connector 30 and the power section 11 of the connector 14 as disclosed in FIG. 2, even though the power region 40 of the subject connector 30 and the power section 11 of the complementary connector 14 have lengthwise deviation therebetween. It is also noted that the allowed deviation in the lengthwise direction between the power region 40 of the connector 30 and the power section 11 of the complementary connector 14 can be within aforementioned 0.4 mm which is far larger than any acceptable tolerance for an inserted male contact disclosed in the common connector having a regular opening of the passageway of the power region.

It can be understood that when the connector 30 is mating with the complementary connector 14 as disclosed in FIG. 2, the space 90 between the power region 40 and the signal region 50 of the connector 30, which is larger than the partition 20 of the complementary connector 14, may receive the partition 20 of the complementary connector 14 therein and the signal region 50 of the connector 30 is mated and aligned with the signal section 13 of the complementary connector 14 so that the contact 70 in the passageway 52 of the signal region 50 of the connector 30 precisely engages the corresponding signal male contact of the complementary connector 14. Differently, the power region 40 of the connector 30 may engage the power section 11 of the complementary connector 14 with a slight deviation in the lengthwise direction, but this deviation still allows the pin type male contact of the complementary connector 14 to extend through the laterally expanded opening 41 of the passageway 42 of the power region 40 without any obstacles and be sufficiently mechanically and electrically sandwiched between two arms 66 of the contact 60 in the passageway 42.

It is also seen that the reason why the blades 34 and 36 are integrally connected to the rear of the housing 30, is that the present embodiment is designedly coupled to a card edge connector as mentioned before. Under this situation, the connector 30 functions as an adaptor to connectively intermediate between the complementary connector 14 as shown in FIG. 2 on the PC board and such card edge connector wherein such card edge connector is connected to power and signal flat cables through IDC for communication with a main PC board. Certainly, the blades 34 and 36 of the subject connector 30 can be removed therefrom and be properly shaped to be directly connected to flat cables through IDC for completion of circuit path between the main PC board and the PC board on which the complementary connector 14 is seated. It is also seen that in the present invention, the blade 34 behind the power region 40 and the blade 36 behind the signal region 50 are at different level in a vertical direction. This difference only results from the power region having only one row of passageway 42 and the blade 34 extending from proximate the top portion of the power region 40, but the signal region 50 having two rows of passageways 52 and the blade 36 extending from the middle portion of the signal region 50.

While the invention has been described in connection with what is presently considered to be the most practical and preferred embodiment, it is to be understood that the invention is not limited to the disclosed embodiment but, on the contrary, is intended to cover various modifications and equivalent arrangements included within the spirit and the scope of the appended claims.

Therefore, persons of ordinary skill in this field are to understand that all such equivalent structures are to be included within the scope of the following claims:

What is claimed is:

1. A unitary female connector comprising a first power region and a second signal region which are juxtaposed lengthwise along a housing of said connector for respectively mating with a power section and a signal section of a complementary male connector;

said first power region having a plurality of first large passageways extending therethrough in a front-to-back direction for receiving a corresponding number of first large power contacts therein to mate with large power pins of the power section of the complementary male connector, respectively;

said second signal region having a plurality of second small passageways extending therethrough in the front-to-back direction for receiving a corresponding number of second small signal contacts therein to mate with small signal pins of the signal section of the complementary male connector, respectively;

said first large power contact including thereof a pair of first arms positioned at a front end and arranged to oppositely face each other in a vertical direction to form a lateral through-opening in a lengthwise direction along said housing;

said second small signal contact including thereof a pair of second arms positioned at a front end and arranged to oppositely face each other in a horizontal direction; wherein a lengthwise dimension of said power region of said female connector is substantially smaller than that of an inner space of said power section of said male connector for allowing lengthwise mating deviation between said male and female connectors; and wherein said first large power contact includes a large U-shaped body having a large base and two large retention walls respectively extending from two sides of said large base and perpendicular to said large base, said pair of first arms extending forwardly from said two large retention walls, respectively, and a large tail directly integrally extending rearward from one of said large retention walls; said second small signal contact includes a small U-shaped body having a small base and two small retention walls respectively extending vertically from two sides of said small base, said pair of second arms extending forwardly from said two small retention walls, respectively, a plate extending rearward from said small base and a small tail integrally extending rearward from said plate.

* * * * *